US010119774B1

(12) United States Patent
Kosa et al.

(10) Patent No.: US 10,119,774 B1
(45) Date of Patent: Nov. 6, 2018

(54) INSTANTANEOUS COOLER/FREEZER USING ORBITAL SHAKE METHOD

(71) Applicants: Umit Kosa, Izmir (TR); Kerem Erhan, Izmir (TR)

(72) Inventors: Umit Kosa, Izmir (TR); Kerem Erhan, Izmir (TR)

( * ) Notice: Subject to any disclaimer, the term of this patent is extended or adjusted under 35 U.S.C. 154(b) by 0 days.

(21) Appl. No.: 15/710,810

(22) Filed: Sep. 20, 2017

(51) Int. Cl.

| | |
|---|---|
| ***F28F 13/12*** | (2006.01) |
| ***F25D 17/06*** | (2006.01) |
| *B67D 1/08* | (2006.01) |
| *F25D 31/00* | (2006.01) |
| *F25D 17/02* | (2006.01) |

(52) U.S. Cl.
CPC ..... *F28F 13/125* (2013.01); *F25D 17/06* (2013.01); *B67D 1/0867* (2013.01); *F25D 17/02* (2013.01); *F25D 31/006* (2013.01); *F25D 31/007* (2013.01); *F25D 2331/803* (2013.01); *F25D 2400/28* (2013.01); *F25D 2400/30* (2013.01)

(58) Field of Classification Search
CPC .... F28F 13/125; F25D 17/06; F25D 2400/28; F25D 2400/30; F25D 2331/8015; F25D 2331/803; F25D 31/006; F25D 31/007; F25D 17/02; B67D 1/0867
USPC ..... 165/122, 104.19, 104.22, 166, 167; 62/370, 381
See application file for complete search history.

(56) References Cited

U.S. PATENT DOCUMENTS

| | | | | |
|---|---|---|---|---|
| 3,888,092 | A * | 6/1975 | Fisher | F25D 17/02 62/376 |
| 5,237,835 | A * | 8/1993 | Brochier | F25D 17/02 62/336 |
| 8,056,347 | B2 * | 11/2011 | Flinner | F25B 21/04 62/3.2 |
| 8,516,849 | B2 * | 8/2013 | Mooijer | F25D 16/00 62/457.5 |
| 9,845,988 | B2 * | 12/2017 | Shuntich | F25D 31/007 |
| 2010/0218515 | A1 * | 9/2010 | Fink | F25D 17/02 62/62 |
| 2015/0308728 | A1 * | 10/2015 | Pavlik | F25D 15/00 62/115 |

* cited by examiner

*Primary Examiner* — Jianying Atkisson
*Assistant Examiner* — Joel Attey
(74) *Attorney, Agent, or Firm* — Gokalp Bayramoglu

(57) ABSTRACT

The invention discloses instantaneous cooler/freezer using orbital shake method. The instantaneous cooler/freezer using orbital shake method includes a cooling liquid, a flow pump, a reserve tank, a plate heat exchanger, a liquid entrance hole, a cooling chamber, an exit hole, a cooling gas entrance, a gas exit hole, a plurality of cooling liquid distribution channels, an expandable envelope with pockets, a valve, a flat inner cover, a cooling chamber cover having led lights placed at sides for each bottle to inform a user in case of a problem, a rakor, a plurality of conical springs, a laser thermometer, a reduced motor, an eccentric bearing, is used to enables the cooling chamber to be in orbital shake motion, a plurality of roller ball bearings, a plurality of horizontal guide bearings. The instantaneous cooler/freezer using orbital shake method specifically build for packaged beverages, food, and similarly all packaged objects.

9 Claims, 11 Drawing Sheets

INSTANTANEOUS COOLER/FREEZER USING ORBITAL SHAKE METHOD

FIELD OF INVENTION

The invention that is the objective of this application, is instantaneous cooler/freezer using orbital shake method specifically build for packaged beverages, food, and similarly.

BACKGROUND

Now a days, there are several systems and techniques to cool or freeze packaged beverages, food and similarly all packaged objects. Among those ones, the most renown one is the standard refrigerators. The refrigerators, which belongs to preceding systems of cooling and freezing are for general use and inefficient. Another cooling technique is to immerse bottles in an envelope which is in a cooling liquid.

On the process of immersing in a cooling liquid and rotating, the product (bottles, cans etc.) is damped, and needs to be wiped and dried by the user. The fact that the liquid that is used in generally water, makes the process slow and not preferred in the industry.

On another process instead of water, anti-freeze is used as a cooling liquid which in is an envelope immersed. The product is placed in that envelope to be kept dry. However, because of the immobility of the envelope cooling process is not fast enough for the packaged liquids.

The fact that the refrigerators and deep freezers are designed for general purpose and not specifically cool or freeze down packaged liquids, which are highly low in terms of efficiency. In an average refrigerator, it takes 4 hours to cool down 1 packaged drink of 500 ml, from 24 degrees Celsius to 4 degrees Celsius. In a deep freezer same process takes about 50 minutes. Moreover, refrigerators and deep freezers are turned on all 24 hours of the day. That increases cost of electricity for the users.

The invention that uses currently known techniques and is stated in the document TR 2006/02045; is about a rapid cooling system and mechanics. However, in that document the orbital shake method is not stated. Unlike the orbital shake method, the method described in that document, cannot provide a homogeneous cooling. The reason of the homogeneous cooling provided by the orbital shake method is that the liquid is forced to move by the inner surface of package creating a vortex. Again, this method is absent in the document TR 2006/02045.

Moreover, on the method stated in the document TR 2006/02045, there is no envelope to place the bottles in.

In other patent documents using the currently known technique of placing the product in an envelope immersed in a cooling liquid, anti-freeze is used instead of water. But there is no motion mechanism. Because of that the method is neither fast enough nor homogeneously cools down the product.

Using the technique with the orbital/Shake method, it can cool down a packaged (plastic, can and glass bottles) liquids from 24 degrees Celsius to 4 degrees Celsius under 2 minutes. While the refrigerators and deep freezers requires to be turned on 24 hours of the day, it is sufficient to switch on the instant cooler/freezer only 15 minutes before using it.

Looking at currently known techniques, it cannot find one that has the specifications of the instant cooler/freezer with orbital shake technique.

SUMMARY OF THE INVENTION

The present invention, the instantaneous cooler/freezer using the orbital shake method, is about eliminating the inconveniences of the currently known techniques and bring new, more advantageous features.

The present invention, the instantaneous cooler/freezer using the orbital shake method, has the advantages of being economic, practical, providing fast and homogeneously cooled down products that are served dry.

The purpose of the present invention is to cool or freeze down packaged liquids in an economical, practical, fast and homogeneously cooled, and served dried manner.

Another purpose of the present invention is to diminish electric consumption significantly by requiring only 15 minutes to be turned on before using as opposed to refrigerators that have to be on for 24 hours.

A preferred structuring of the invention is the presence of the cooling liquid distribution channels that, when necessary, with the use of the valves, can control the flow rate of the liquid transfer in the expandable envelopes that are in the cooling chamber.

A preferred structuring of the invention, is the presence of an inner cover with holes that covers the cooling chamber and the valves.

A preferred structuring of the invention, is the presence of an expandable envelope which is connected to valves from both ends and that provides a high surface area contact.

A preferred structuring of the invention, is, in case of a rupture on the envelope, the presence of a rakor that connects the envelopes with valves and that can stop the flow of the cooler liquid from inside.

A preferred structuring of the invention, is the presence of conical springs with thermometer attached to their tips.

A preferred structuring of the invention, is the presence of laser thermometer.

A preferred structuring of the invention, is the presence of plate heat exchangers that provides efficient cooling because of high surface of contact due to separate and numerous plates.

A preferred structuring of the invention, is that, by changing its cooling chamber module, it can be used to instantly freeze meat, fish, chicken and similarly all packaged objects.

A preferred structuring of the invention, is that, by changing its cooling chamber module, it can be used to hygienically store meat, fish, chicken and similarly all packaged objects.

A preferred structuring of the invention, is the presence of horizontal ball bearings that are synchronized with the orbital shake motor.

A preferred structuring of the invention is the presence of cooling gas circulation and cooling liquid circulation in a closed circuit.

A preferred structuring of the invention is the presence of a synchronized system of cooling liquid and cooling gas circulation, orbital shake motor, horizontal guide bearings that enables the cooling chamber to get in orbital motion on top of horizontal guide bearings on the same time.

A preferred structuring of the invention is the presence of roller ball bearings that carries the weight of the cooling liquid and the product that will be cooled/freezed. That prevents any weight load to reduced motor.

BRIEF DESCRIPTION OF THE DRAWINGS

Below is the list and description of the schematics In order to better explain the present invention Instantaneous Cooler/Freezer that uses orbital shake method.

DESCRIPTION OF PARTS/SECTIONS/ELEMENTS THAT CONSIST OF THE INVENTION

Figure 1:
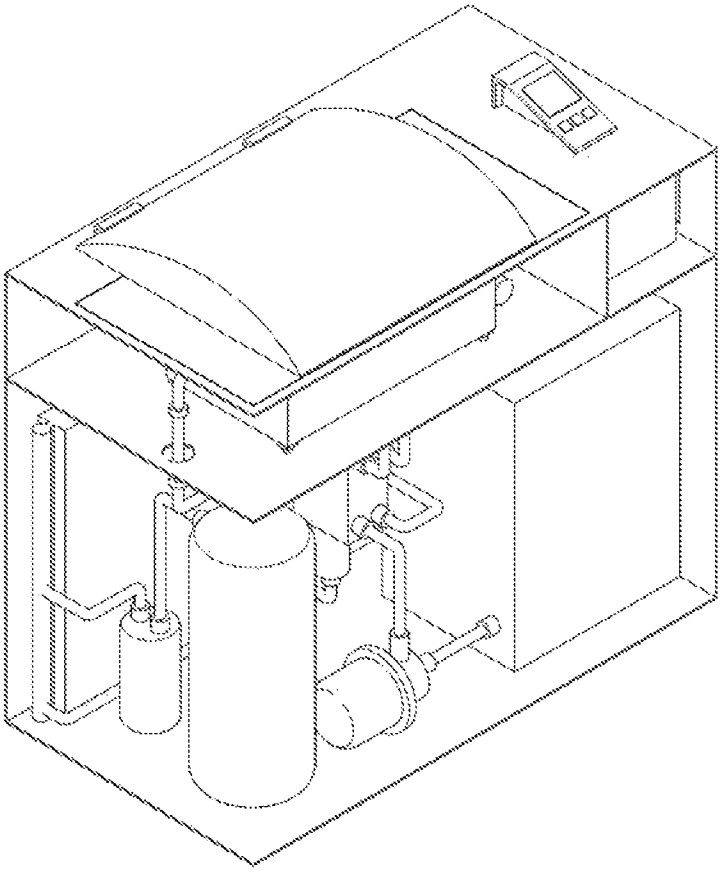
FIG. 1: General Overview 1
Figure 2:
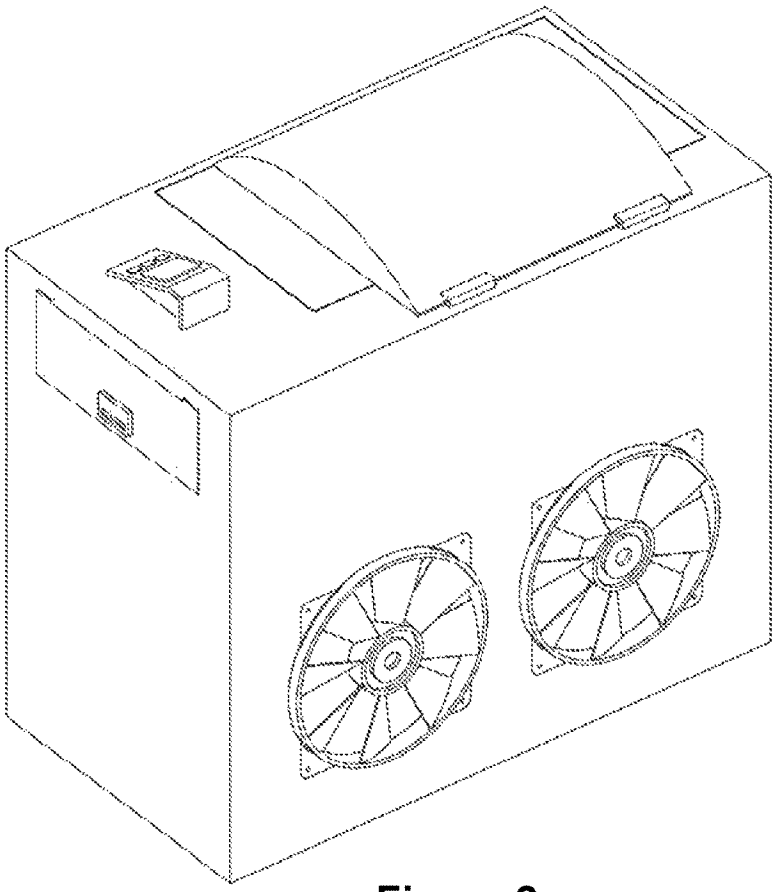
FIG. 2: General Overview 2

Below is the number and description of the parts sections elements of the invention, which are numerated in the schematics in order to better explain the present invention Instantaneous Cooler/Freezer that uses orbital shake method that is specifically developed for this sector:

1. Compressor
2. Flow Pump
3. Reserve Tank
4. Oil Separator
5. Condenser
6. Fan
7. Liquid accumulator
8. Plate Heat Exchanger
9. Expansion Valve
10. Cooling Liquid exit pipe
11. Liquid return hole to reserve tank
12. Drier
13. Elastic hose
14. Liquid entrance hole to plate heat exchanger
15. Liquid Exit hole of plate heat exchanger
16. Cooling gas entrance hole of plate heat exchanger
17. Cooling gas exit hole of plate heat exchanger
18. External case of the machinery
19. External big lid
20. Cooling Chamber
21. Distribution channels
22. Valve
23. Control Screen
24. Control Panel
25. Cover of electric system panel
26. Electric system box
27. Inner cover with holes that covers the cooling chamber and the valves.
28. Expandable Envelope
29. Cooling Chamber Cover
30. Rakor
31. Conical Spring
32. Thermometer probe
33. Laser Thermometer
34. Information LED
35. Reduced Motor
36. Eccentric Bearing
37. Roller Ball Bearing
38. Horizontal ball bearings
39. Cooling Liquid

DETAILED DESCRIPTION OF THE INVENTION

The present invention, instantaneous Cooler/Freezer that uses orbital shake method is about cooling down in very short amount of time packaged beverages, food, and similarly all packaged objects.

Instantaneous Cooler/Freezer that uses orbital shake method features are characterized by; cooling liquid that can be cooled down to −30 degrees Celsius without freezing nor losing its fluidity (39), flow pump (2) that circulates the cooling liquid (39) and provides pressure when necessary, the reserve tank (3) that contains the cooling liquid (39) which has the thermal energy required to cool down packaged beverages or food etc. without any interruption, plate heat exchanger (8) where the cooling gas and the cooling liquids interacts without mixing with each other, the liquid entrance hole (14) from which the cooling liquid (39) coming from the reserve tank (3) is transmitted to plate heat exchanger (8), cooling chamber (20) that serves to cool down packaged beverages and food, the exit hole (15) from which the cooled down cooling liquid (39) is transmitted to cooling chamber (20), cooling gas entrance (16) from which the cooling gas enters the plate heat exchanger (8) in order to cool down the cooling liquid (39), gas exit hole (17) from which the cooling gas that completed the cooling process exits for the process that prevents the risk of liquification of the cooling gas, the cooling liquid (39) distribution channels (21) that enable the cooling liquid (39) to divert in to 3 lines for 3 different bottle modules, the expandable envelope (28) with pockets which with the help of pressure when the cooling process starts, can envelope the bottle in it no matter what is its shape or size, in case of a technical problem, valve (22) that is connected to one end of the distribution channels (21) serving to stop the flow of the cooling liquid (39) that goes to the envelope (28), the flat inner cover (27) that enables to reach the valves in case of a technical problem, cooling chamber cover (29) having led lights (34) placed at sides for each bottle to inform the user in case of a problem, helping the expandable envelope (28) to envelope the bottles by keeping pressure and the expandable envelope (28) inside the cooling chamber (20), the rakor (30) that connects the expandable envelope (28) with the valve (22), conical springs (31) that can measure the temperature of the different size bottles etc. with the help of thermometer probes (32) attached to its tips, laser thermometer (33) that can measure each bottle separately and can transmit the data to the system, information led (34) situated just besides of each pockets that can indicate if there is a bottle with temperature dangerously different from the average temperature of all the bottles, needing to be taking out of the system, reduced motor (35) that can shake the cooling chamber (20) at the desired angular velocity, eccentric bearing (36) that enables the cooling chamber (20) to be in orbital shake motion, and by using the horizontal guide bearings (38) as well as the eccentric bearings (36) the orbital motion of the cooling chamber (20) which is carried by the roller ball bearing (37).

In the instantaneous cooler/freezer that uses orbital shake method, an expandable envelope (28) which can envelope the material to be cooled on a set pressure by contacting all available surface is used. This expandable envelope (28) enables the liquid cooling with direct contact to products which is significantly more efficient than the gas cooling. Besides than this cooling system by enveloping the object to be cooled, to ensure the homogenous distribution of the liquid, thus, the temperature, the most efficient method, orbital shake is used. A reducer motor (35) is used to ensure orbital shake motion. The reduced motor (35), is active until the product reaches the desired temperature. By Law of Inertia, Orbital shake method puts the liquid to be cooled in motion much faster than the existing central rotation methods. Due to this active shaking movement (orbital shake) and the special expandable envelope (28) that can cover the surface of the package, the heat transfer between the cooling liquid (39) and the package is realized at fast as possible and the product is cooled rapidly.

Moreover, the instant cooler/freezer with orbital shake method, not only packaged liquids but also, by simply changing the cooling chamber (20) module, meet, fish, chicken and similarly any packaged food can be freezed and hygienically stored.

When the invention is on standby or turned off, there is no cooling fluid (39) in the cooling chamber (20). On standby, if the cooling liquid (39) temperature rises, the present invention periodically checks and adjusts the cooling liquid (39) temperature to the required degree Celsius. If package is made of glass or similarly fragile nature material sensitive to rapid temperature variances, flow pump (2) adapts the flow rate of the cooling liquid (39) accordingly to prevent any damage to the package.

Figure 3:
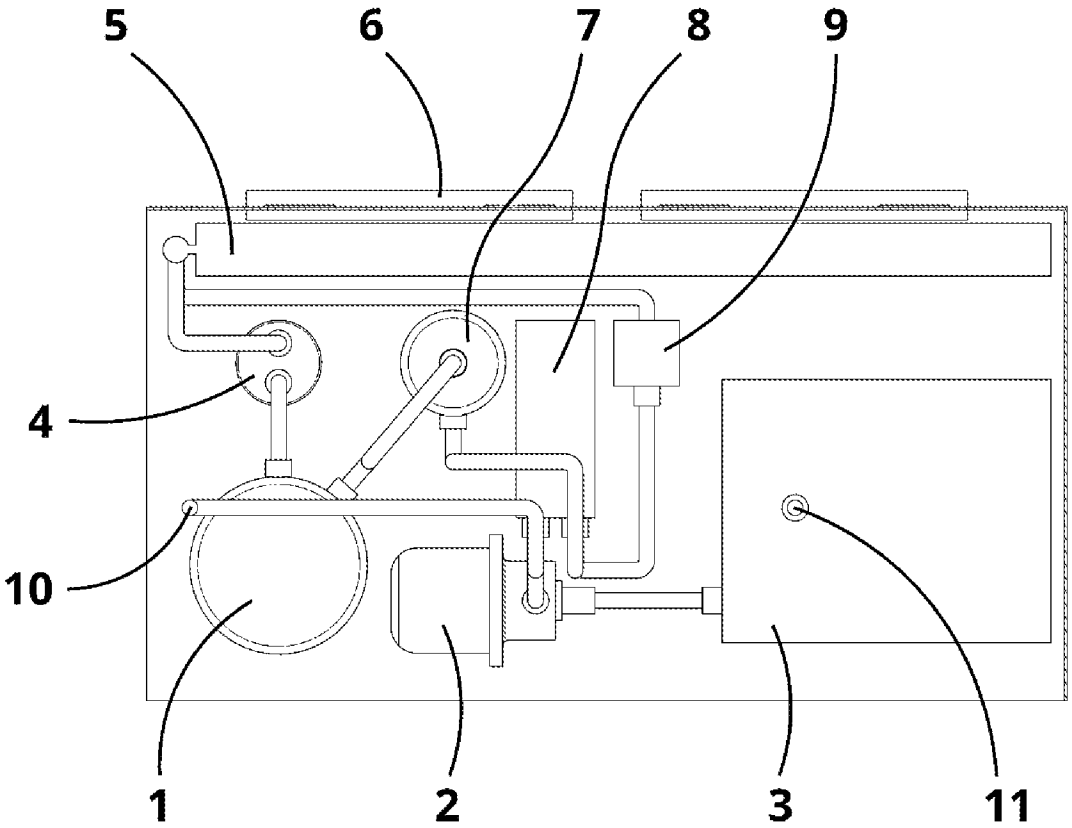
FIG. 3: Upper view of the inner section

In FIG. 3 is the upper view of the inner section. In this figure, there is the relative positioning of the compressor (1) that transmits the cooling gas, the flow pump (2) that ensures the circulation of the cooling liquid in the system, the reserve tank (3) that can store the necessary heat energy for uninterrupted cooling, the oil separator (4) in order to separate cooling gas and the oil, condenser (5) that liquifies the cooling gas, the fan (6) that cools down the condenser (5), liquid accumulator (7) that prevents the cooling gas to enter the compressor (1) in liquid form, plate heat exchanger (8) where the cooling gas and the cooling liquids interacts without mixing with each other, expansion valve (9) that decrease the pressure of the cooling gas coming from condenser (5), the cooling liquid exit pipe (10), Liquid return hole to reserve tank, with respect to each other.

Figure 4:
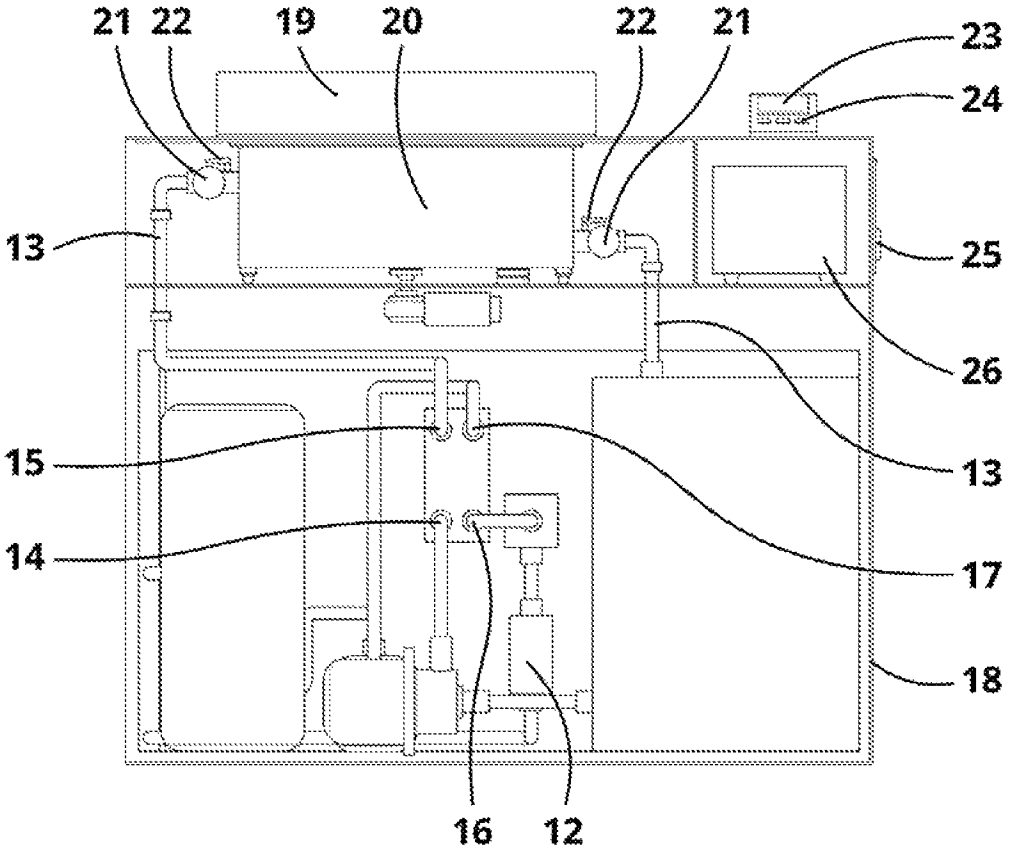
FIG. 4: General Frontal Overview

In FIG. 4 is the general frontal overview. In this figure, there is the relative positioning of the drier (12) that filters the humidity, acid and dust, elastic hose (13) that is connected to cooling chamber, liquid entrance hole (14) to plate heat exchanger (8) from where the cooling liquid (39) that comes from the reserve tank (3) enters, liquid exit hole of plate heat exchanger (15) from where the cooled cooling liquid (39) is send to cooling chamber (20), cooling gas entrance hole of plate heat exchanger (16), cooling gas exit hole of plate heat exchanger (17) from where the cooling gas is transmitted to liquid accumulator (7), external case of the machinery (18) that can be custom designed, external big lid (19) that is closed before turning the system on to complete insulation of the system, cooling chamber (20), distribution channels (21), valve (22), control screen (23), control panel (24), Cover of electric system panel (25) that can be operated easily to grant access to electric panel, liquid proof electric system box (26) with respect to each other.

Figure 5:
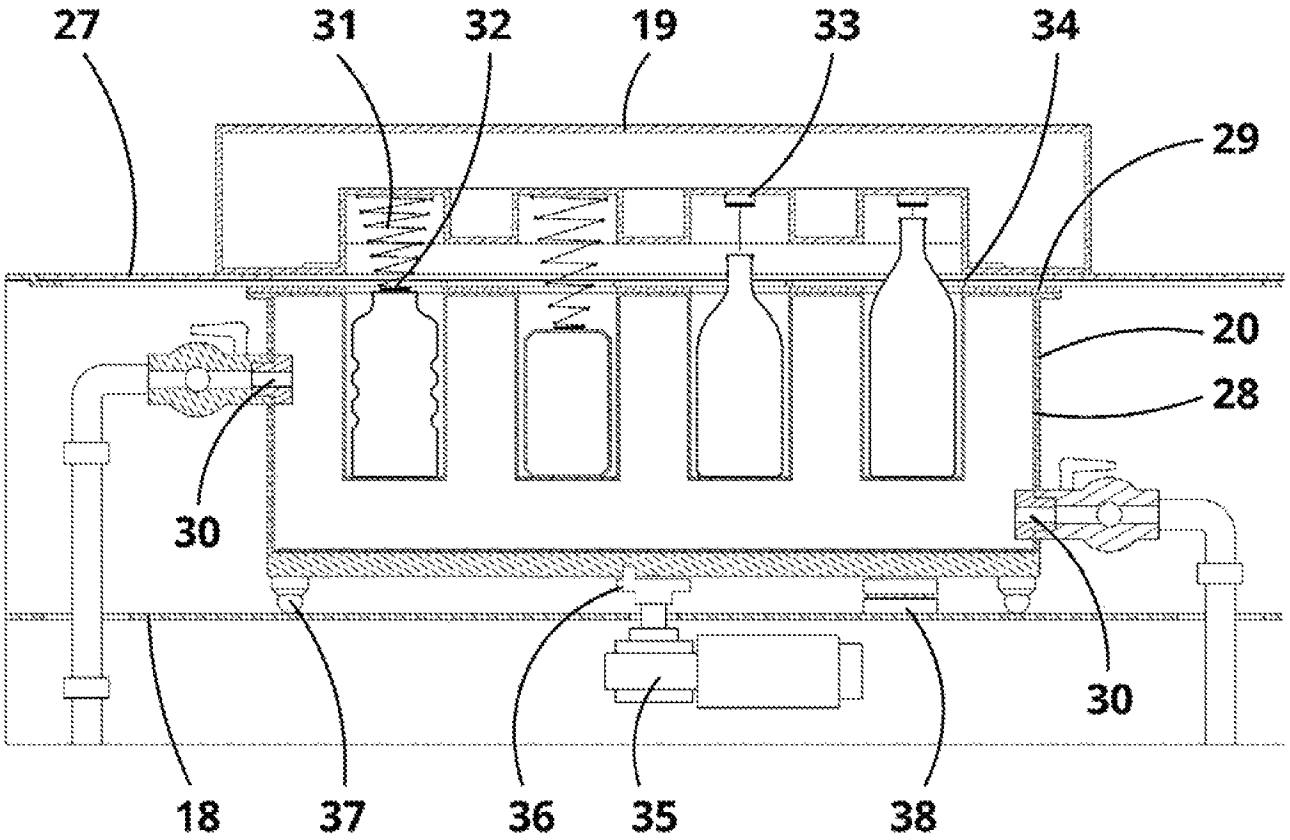
FIG. 5: Inner section front view
Figure 6:
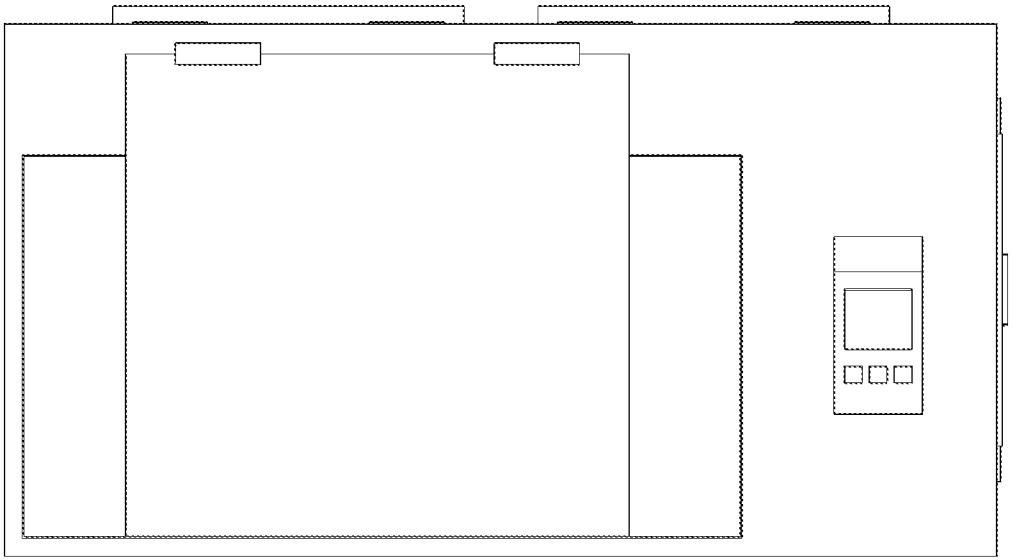
FIG. 6: General upper view
Figure 7:
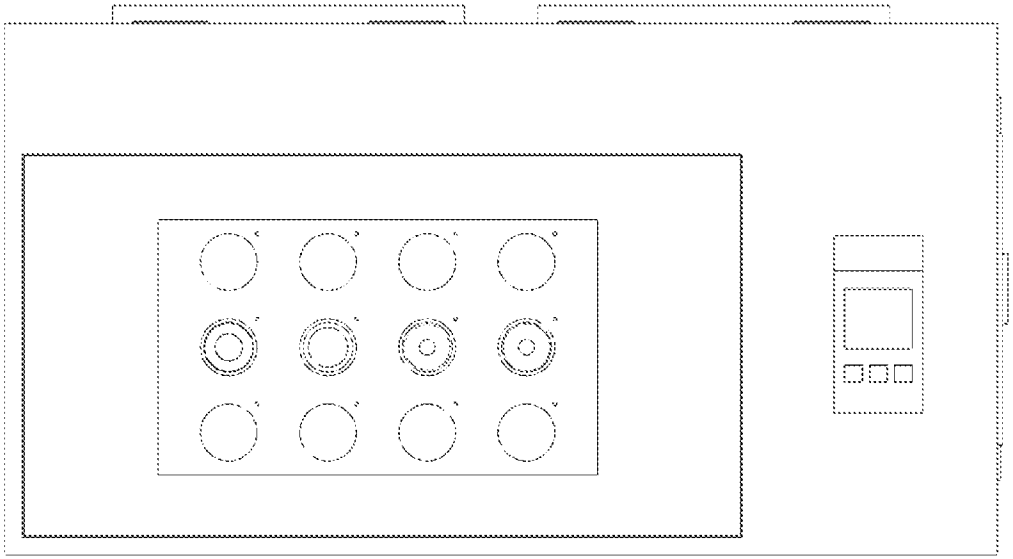
FIG. 7: General upper view without cover
Figure 8:
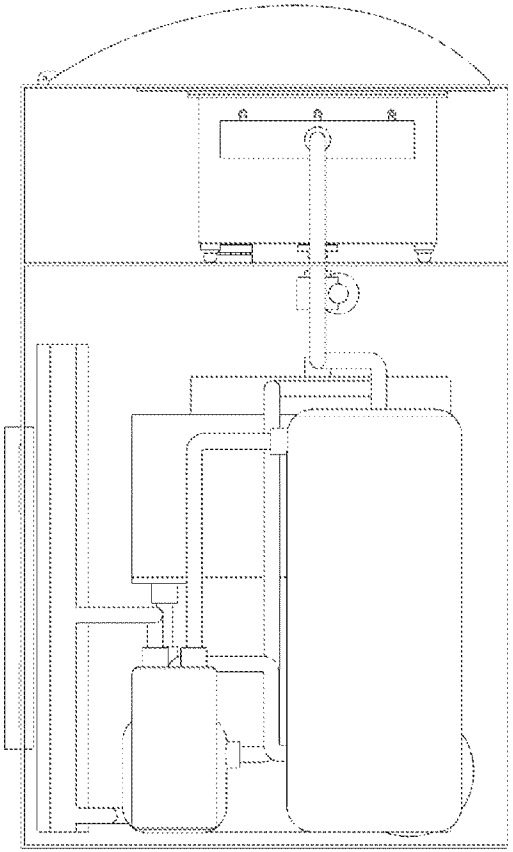
FIG. 8: General side view
Figure 9:
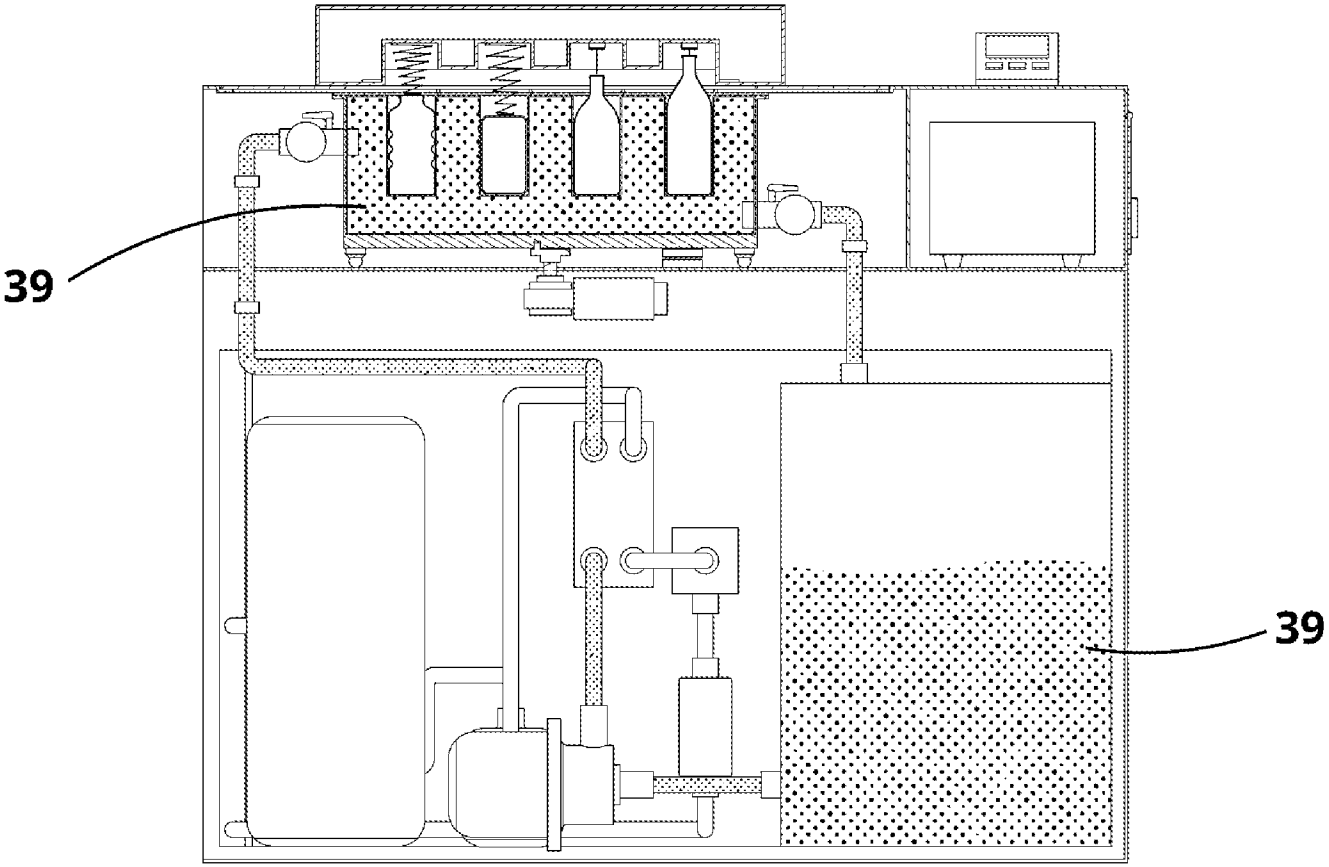
FIG. 9: The view of the system when it is operating
Figure 10:
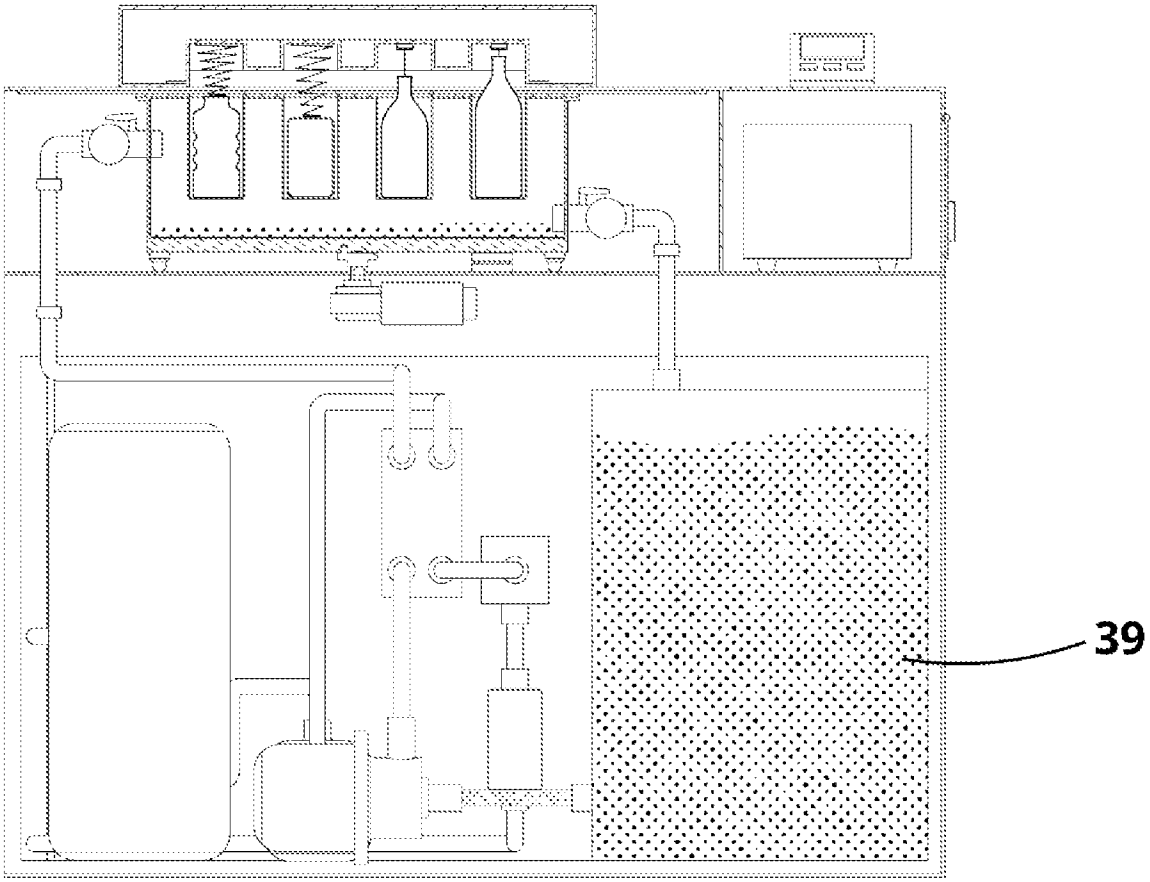
FIG. 10: The view of the system when at standby.
Figure 11:
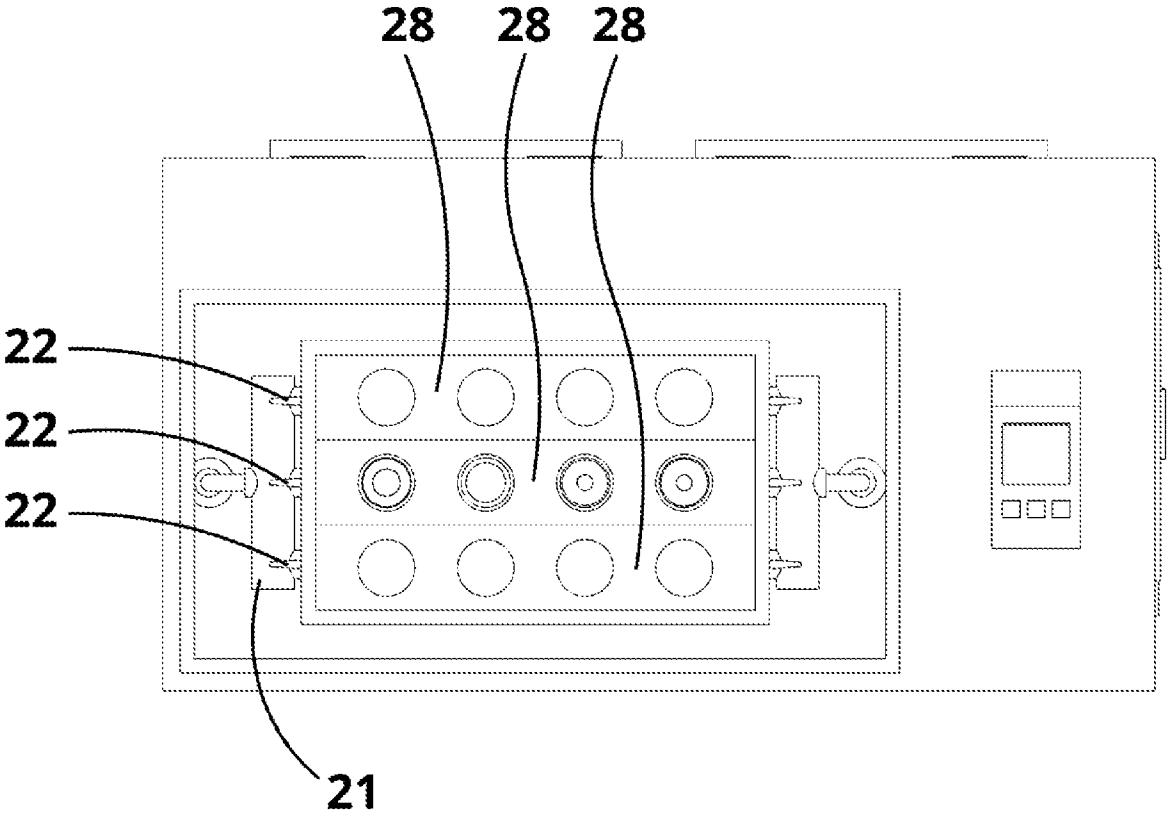
FIG. 11: General upper view without cover

In FIG. 5 is the inner section front view. In this figure, there is the relative positioning of the external case of the machinery (18) that can be custom designed, roller ball bearing (37), eccentric bearing (36), reducer motor (35), horizontal ball bearings (38), rakor (30), expandable envelope (28), cooling chamber (20), cooling chamber cover (29), information led (34), laser thermometer (33), External big lid (19), thermometer probe (32) that can measure each bottle's temperature separately and transmit the data to the system, conical spring (31), inner cover with holes that covers the cooling chamber and the valves (27), with respect to each other.

In order that the instant cooler/freezer with orbital shake method operates properly, it first measures the temperature of the packaged product with conic spring (31) with thermometer probes (32) or laser thermometers (33), then calculates the amount of time and the required rate of rotation. Then the users press the start button on the control panel (24). If there is one or more bottles with significantly different temperature than the other ones' average, the informational leds (34) signals the user to take out that/those bottles from the system. When the problem is solved, that the system starts operating.

The orbital shake method is a highly efficient method of mixing liquids by inducing of centered rotation. With the start of the reducing motor, shaking, gas circulation and cooling liquid (39) circulation starts simultaneously. By using the horizontal guide bearings (38) as well as the eccentric bearings (36), the orbital motion of the cooling chamber (20) which is carried by the roller ball bearing starts.

In the instant cooler/freezer with orbital shake method, there are two closed circulation systems. One is the cooling gas, the other one is the cooling liquid (39). Cooling gas circulation; The cooling gas that is heated up and liquefied, exit the compressor (1) and enters the oil separator (4). In there, any possible oil residue is separated from the cooling gas. The cooling gas separated from oil, enters the condenser (5) and cools down. After cooling down, the cooling gas enters the drier (12) and gets separated from any undesired particles. After the separation process, the cooling gas which is in liquid state is depressurized at the expansion valve (9) to the desired level, enters the plate heat exchanger (8) through cooling gas entrance hole of plate heat exchanger (16). After the cooling process, it heats up and exits the plate heat exchanger (8) through cooling gas exit hole of plate heat exchanger (17). Then it enters the liquid accumulator (7) to get filtered in order to prevent liquification due to heating up. After filtration, it enters again the compressor (1). This completes the cooling gas circulation circuit.

Cooling liquid (39) circulation; the cooling liquid (39) stored in the reserve tank (3) is directed towards the liquid entrance hole to plate heat exchanger (14) with the use of flow pump (2). Once the cooling liquid (39) is cooled down in the plate heat exchanger (8), the cooling liquid (39) exits through liquid Exit hole of plate heat exchanger (15). Then cooling liquid (39) passes through the elastic hose (13) and separated into 3 branches in the distribution channels (21).

The cooling liquid (39) then passes through the valve (22) and rakor (30), and fills in the expandable envelope (28) which is situated in the cooling chamber (20). Once the packaged product is cooled down, the cooling liquid (39) returns back to the reserve tank (20) through liquid return hole to reserve tank (11).

During the process, various thermometers such as thermometer probes (32), conical spring (31) thermometer or laser thermometers. Those thermometers keeps measuring the temperature of the packaged product until the desired degree. When the desired degree is reached, the system stops. Once this happens, it can be indicated by audio or visual signals with the use of control screen (23).

What is claimed is:

1. An instantaneous cooler/freezer apparatus using an orbital shake method comprising:

- a cooling liquid cooled down to −30 degrees Celsius or lower without freezing nor losing fluidity of the cooling liquid;
- a flow pump to circulate the cooling liquid and provide pressure when necessary;
- a reserve tank, to contain the cooling liquid;
- a plate heat exchanger where a cooling gas and the cooling liquid interacts without mixing with each other;

a liquid entrance hole, wherein the cooling liquid coming from the reserve tank is transmitted to the plate heat exchanger through the liquid entrance hole;

an exit hole, wherein the cooling liquid cooled in the plate heat exchanger is transmitted to the cooling chamber through the exit hole;

a cooling gas entrance, wherein the cooling gas enters the plate heat exchanger through the cooling gas entrance in order to cool down the cooling liquid;

a gas exit hole, wherein the cooling gas after completing the cooling process of the cooling the cooling liquid exits from the gas exit hole to prevent a risk of liquification of the cooling gas;

a cooling chamber to cool down packaged beverages and food;

a plurality of cooling liquid distribution channels, wherein the plurality of cooling liquid distribution channels enable the cooling liquid to divert in to 3 lines for 3 different bottle modules in the cooling chamber;

an expandable envelope with pockets in the cooling chamber, wherein the expandable envelope with pockets, with the help of fluid pressure of the cooling liquid, envelops bottles when the cooling process starts;

a valves connected to one end of the distribution channels to stop a flow of the cooling liquid that goes to the envelope;

a flat inner cover that access to the valve in case of a technical problem;

a cooling chamber cover having light-emitting diode (LED) lights placed at sides of the chamber for each bottle to inform a user in case of a problem;

a male coupling, to connect the expandable envelope with the valve;

a plurality of conical springs to measure the temperature of the different size bottles with the help of thermometer probes attached to tips of the conical springs;

a laser thermometer to measure the temperature of each bottle separately and transmit data to the system;

an information LED situated adjacent to each pocket, wherein the information LED indicates if there is a bottle with temperature different from an average temperature of all the bottles and needing to be taken out of the system;

a reduced motor to shake the cooling chamber at a desired angular velocity;

an eccentric bearing to enable the cooling chamber to be moved in the orbital shake motion;

a plurality of roller ball bearings, wherein the plurality of roller ball bearings carry the weight of the cooling liquid and the product that will be cooled/freezed;

a plurality of horizontal guide bearings, wherein the plurality of horizontal guide bearings support the eccentric bearing to induce the orbital motion of the cooling chamber being carried by the roller ball bearings.

2. The instantaneous cooler/freezer apparatus using the orbital shake method according to claim 1, wherein cooling liquid distribution channels with a second valve connected to opposite the one end of the distribution channels to stop the flow of the cooling liquid that goes to the envelope.

3. The instantaneous cooler/freezer apparatus using the orbital shake method according to claim 1, further comprising an inner cover with holes to cover the cooling chamber and the valve.

4. The Instantaneous cooler/freezer apparatus using the orbital shake method according to claim 2, wherein the expandable envelope is connected to the valve and the second valve on opposite ends of the expandable envelope.

5. The instantaneous cooler/freezer apparatus using the orbital shake method according to claim 1, wherein the coupling connects the expandable envelope with the valve.

6. The instantaneous cooler/freezer apparatus using the orbital shake method according to claim 1, wherein the plate heat exchanger includes a plurality of separate plates.

7. The instantaneous cooler/freezer apparatus using the orbital shake method according to claim 1, wherein the horizontal guide bearings are synchronized with the eccentric bearing.

8. The instantaneous cooler/freezer apparatus using the orbital shake method according to claim 1, wherein the cooling gas and the cooling liquid circulate in separate closed circuits.

9. A instantaneous cooler/freezer apparatus using an orbital shake method, comprising:

a cooling liquid cooled down to −30 degrees Celsius or lower without freezing nor losing fluidity of the cooling liquid;

a flow pump to circulate the cooling liquid and provide pressure when necessary; a reserve tank, to contain the cooling liquid;

a plate heat exchanger where a cooling gas and the cooling liquid interacts without mixing with each other;

a liquid entrance hole, wherein the cooling liquid coming from the reserve tank is transmitted to the plate heat exchanger through the liquid entrance hole;

an exit hole, wherein the cooling liquid cooled in the plate heat exchanger is transmitted to the cooling chamber through the exit hole;

a cooling gas entrance, wherein the cooling gas enters the plate heat exchanger through the cooling gas entrance in order to cool down the cooling liquid;

a gas exit hole, wherein the cooling gas after completing the cooling process of cooling the cooling liquid exits from the gas exit hole to prevent a risk of liquification of the cooling gas;

a cooling chamber to cool down packaged beverages and food;

a plurality of cooling liquid distribution channels, wherein the plurality of cooling liquid distribution channels enable the cooling liquid to divert in to 3 lines for 3 different bottle modules in the cooling chamber;

an expandable envelope with pockets in the cooling chamber, wherein the expandable envelope with pockets, with the help of fluid pressure of the cooling liquid, envelops bottles when the cooling process starts;

a valve connected to one end of the distribution channels to stop a flow of the cooling liquid that goes to the envelope;

a flat inner cover that access to the valve in case of a technical problem;

a cooling chamber cover having light-emitting diode (LED) lights placed at sides of the chamber for each bottle to inform a user in case of a problem;

a male coupling, to connect the expandable envelope with the valve;

a plurality of laser thermometers to measure the temperature of the different size bottles with the help of thermometer probes attached to tips of the laser thermometers;

a laser thermometer to measure the temperature of each bottle separately and transmit data to the system;

an information LED situated adjacent to each pocket, wherein the information LED indicates if there is a bottle with temperature different from an average temperature of all the bottles and needing to be taken out of the system;

a reduced motor to shake the cooling chamber at a desired angular velocity;

an eccentric bearing to enable the cooling chamber to be moved in the orbital shake motion;

a plurality of roller ball bearings, wherein the plurality of roller ball bearings carry the weight of the cooling liquid and the product that will be cooled/freezed;

a plurality of horizontal guide bearings, wherein the plurality of horizontal guide bearings support the eccentric bearing to induce the orbital motion of the cooling chamber being carried by the roller ball bearings.

* * * * *